US005354019A

United States Patent [19]

Braun

[11] Patent Number: 5,354,019

[45] Date of Patent: Oct. 11, 1994

[54] HOLDING MEANS FOR MOUNTING AN ELECTRICAL COMPONENT ACTUATED BY A ROTATING SPINDLE ON AN OBJECT

[75] Inventor: Dieter Braun, Brunnthal, Fed. Rep. of Germany

[73] Assignee: Wilhelm Ruf KG, Munich, Fed. Rep. of Germany

[21] Appl. No.: 83,022

[22] Filed: Jun. 25, 1993

[30] Foreign Application Priority Data

Jun. 26, 1992 [DE] Fed. Rep. of Germany ..... 4221024

[51] Int. Cl.[5] ..... G12B 9/00

[52] U.S. Cl. ..... 248/27.1; 361/679; 464/105

[58] Field of Search ..... 248/27.1, 27.3; 361/727, 726, 644, 725, 679; 312/229; 464/105, 153, 182

[56] References Cited

U.S. PATENT DOCUMENTS

| | | | |
|---|---|---|---|
| 1,459,035 | 6/1923 | Raisig | 464/105 |
| 1,573,197 | 2/1926 | Schuette | 464/105 X |
| 3,868,077 | 2/1975 | Van Tiel | 248/27.1 |
| 4,066,838 | 1/1978 | Fujita | 248/27.1 X |
| 4,177,498 | 12/1979 | Weitz | 248/27.1 X |
| 4,403,271 | 9/1983 | Flanigan | 248/27.1 X |
| 4,679,728 | 7/1987 | Gregory | 361/726 X |
| 4,857,669 | 8/1989 | Kitamura | 248/27.1 X |
| 4,964,018 | 10/1990 | Mallory | 361/725 |
| 5,162,976 | 11/1992 | Moore | 361/726 |
| 5,284,455 | 2/1994 | Kuribayashi | 464/182 X |

FOREIGN PATENT DOCUMENTS

| | | | |
|---|---|---|---|
| 157120 | 6/1993 | Japan | 464/105 |

*Primary Examiner*—J. Franklin Foss
*Attorney, Agent, or Firm*—Ralph H. Dougherty

[57] ABSTRACT

Apparatus for mounting an electrical component actuated by a rotating spindle (e.g., a potentiometer or a selector switch) having a cross-slide guideway made of two slide components wherein a first slide component is displaceable relative to the second slide component. The second slide component is displaceable relative to the object on which the component is to be supported. The two displacement directions are off-set 90 degrees from each other and extend radially with respect to the axis of rotation of the electrical component.

12 Claims, 5 Drawing Sheets

HOLDING MEANS FOR MOUNTING AN ELECTRICAL COMPONENT ACTUATED BY A ROTATING SPINDLE ON AN OBJECT

FIELD OF THE INVENTION

The invention relates to a holding means for mounting an electrical component actuated by a rotating spindle on an object, such as a potentiometer, the electrical component being guided displaceably relative to the object in a first displacement direction and in a second displacement direction, perpendicular to the first, and the two displacement directions being offset by 90 degrees in relation to the axis of the spindle.

DESCRIPTION OF THE PRIOR ART

An apparatus of this type is shown in EP 0 070 934 A1. As disclosed therein, a potentiometer is displaceably secured with a rotating spindle to a holding plate, a spindle extends through an opening in the potentiometer, opening having enough clearance for the desired displaceability. An annular flange component is rigidly secured to the potentiometer. Secured to the holding plate is a disc-shaped part, which has, parallel to the spindle, a projecting pin, which is guided in an opening of the flange component. A stepped, annular part overlaps the potentiometer as a cap nut would and clamps the disc-shaped part with the pin to the holding plate. This stepped, annular part is screwed to the holding plate. This design makes it possible to displace the potentiometer in two mutually perpendicular displacement directions within a free space of a clearance between the annular flange part and the stepped annular part. This makes it possible to couple the spindle of the potentiometer with a drive part, even if there is a center offset between the drive part and the spindle of the potentiometer.

U.S. Pat. No. 1,459,035 shows a flexible coupling which can be used to connect two spindle ends that are to be coupled with each other. The coupling has a housing with a square recess, the side walls of which form guideways for slide components. Provided on each spindle ends being coupled are two parallel, sliding, mutually perpendicular bearing surfaces. These surfaces slide along associated guideways in the housing. Thus, each of the two spindle ends to be coupled can be displaced in one direction; the result in the case of coupled spindles is that a center offset is possible in two directions that are mutually perpendicular and perpendicular to the longitudinal axis of the spindles.

In addition, German Patent 35 24 308 and German Laid-Open Patent Application 36 24 640 teach mounting the turning driver of a potentiometer in relation to a spring support that can be turned so that it effects a tumbler movement. This can be used to compensate for tilting defects and, to a lesser extent, even center offset defects between the axis of rotation of the potentiometer and a spindle driving the potentiometer.

German Laid-Open Patent Application 37 14 348 (European Patent 0 288 930) teaches a float-mounting of the moving parts of the potentiometer such that the potentiometer spindle and the spring support the potentiometer housing by means of resilient cushioners, which can also compensate for faulty alignment to a certain extent.

BACKGROUND OF THE INVENTION

The housing of an electrical component, for example a potentiometer, is usually secured to an object, which then determines the position of the spindle actuating this component. This can cause problems if the axis of rotation of the electrical component relative to an actuating element is not correctly aligned. For example, a potentiometer can be used as a turning position sensor for the throttle valve of an internal combustion engine with the turning spindle of the potentiometer being coupled by a linkage with the axis of rotation of the throttle valve. As used thus, the potentiometer housing is secured to the engine block and vibrations, installation tolerances or thermal expansions can distort the linkage, having negative effects on the measurements. Similar problems can appear in the adjustment of vehicle brake linings when brake lining wear is detected through the position of a linkage of a potentiometer. The same applies analogously for selector switches used to scan limit positions or for other electrical components that are actuated by a turning spindle.

SUMMARY OF THE INVENTION

The basic invention consists of mounting the potentiometer or other components housing in a cross-slide guideway. The two displacement directions are offset by 90 degrees with respect to each other and are radial to the axis of rotation of the potentiometer. Aside from frictional forces for displacement of the slide components, this gives the capability of force-free compensation for faulty center offset between the axis of rotation of the potentiometer and a mechanism driving the potentiometer. This also ensures strictest linearity of the potentiometer, unlike the case of where the potentiometer and drive spindle are coupled by means of universal joints.

In an advantageous embodiment of the invention, the second slide component has a substantially rectangular recess, wherein two opposing side walls of this recess form a first guideway for receiving the first slide component. This provides a holding and linkage that is simple in design and easy to manufacture and mount.

In a further embodiment, the two slide components have resilient arms with projections jutting outwardly. These projections slide on the associated guideway, reducing the frictional forces and preventing the slide components from tilting. In addition, the resilient arms compensate for tolerance errors, which is particularly important in the case of imprecise manufacture or contamination of the guideway on the object on which the potentiometer is to be mounted. Preferably, limiting stops will be provided in both displacement directions so that the potentiometer will be positioned on assembly at the proper place.

In an alternative embodiment, a metallic leaf spring with two resilient arms is embedded in one of the side walls of the first and/or the second slide component. The arms project over the base element of the slide component and which have cap-like projections secured to their ends. The service life of the holding means is considerably improved by the use of these metallic leaf springs, as the spring qualities of the spring arms are retained even after extremely long operating periods. If the slide component is made of injection-molded plastic, the associated leaf spring can first be inserted into the mold and then solidly connected with the slide component by injecting plastic around it.

In an advantageous further embodiment of the invention, the first slide component is mounted integrally on the housing of the potentiometer, hence the potentiometer housing can be produced together with the first slide component in a single operation, for example, as an injection-molded part.

In a further embodiment of the invention, the second slide component has one each outwardly protruding central section on the side walls forming the second guideway. This enhances the mechanical strength of the holding means.

In another embodiment of the invention, the first slide component has an annular base element on which the two side walls are formed tangentially, these annular bodies serving as supports for the turning parts of the potentiometer. This considerably simplifies engineering for the housing and the first slide component and saves material, while at the same time enhancing the mechanical strength of the first slide component.

OBJECT OF THE INVENTION

The object of the invention, therefore, is to provide a holding means for mounting electrical components, specifically potentiometers, which is capable of compensating even for major dimensional tolerances.

BRIEF DESCRIPTION OF THE DRAWINGS

The foregoing and other objects will become more readily apparent by referring to the following detailed description and the appended drawings in which.

DETAILED DESCRIPTION

Figure 1:
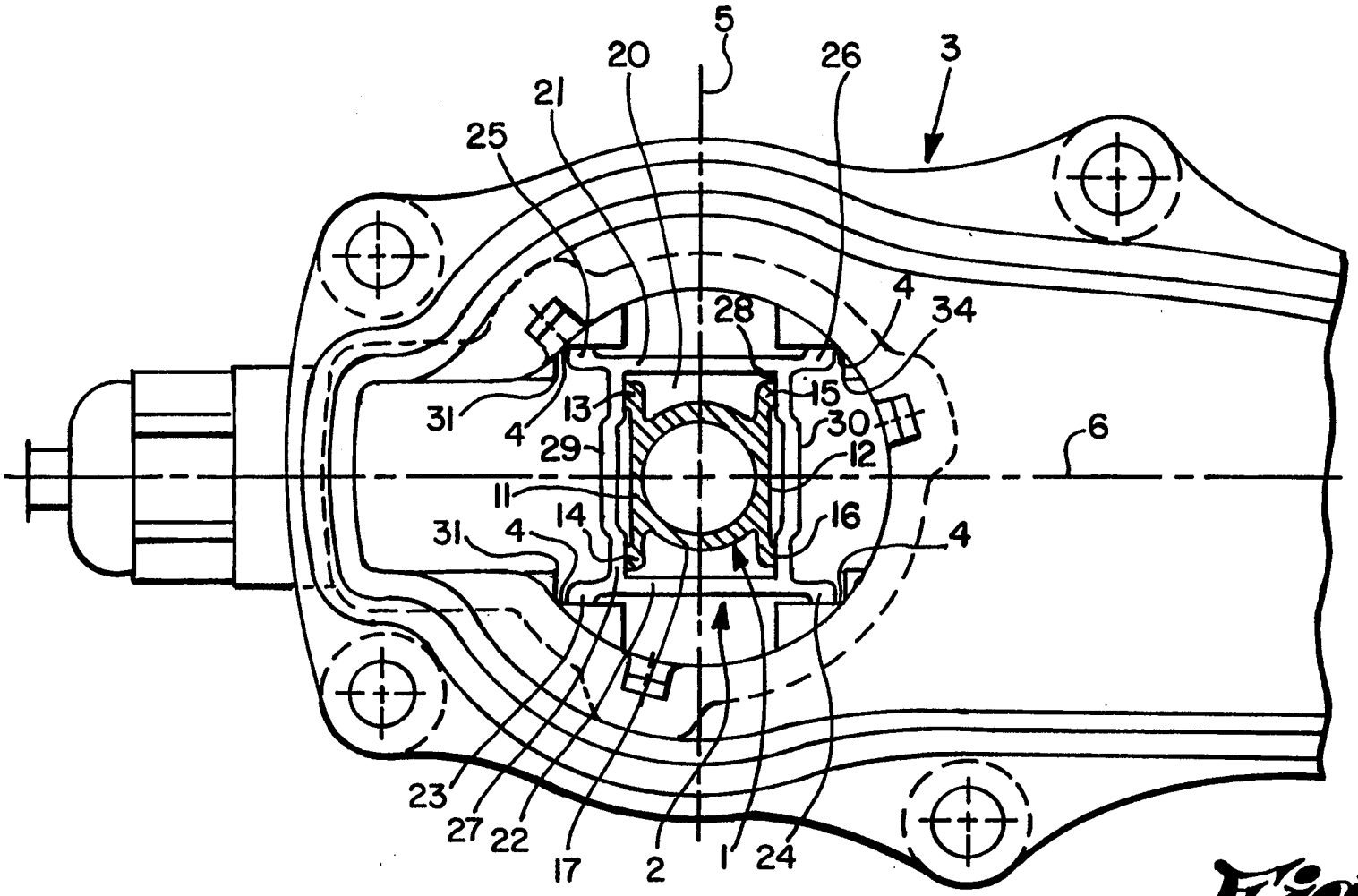
FIG. 1 is a partially cut-away plan view of the holding means as installed.

Referring now to the drawings, and particularly to FIG. 1, a holding means consists basically of a first slide component 1, which is displaceable relative to a second slide component 2. The second slide component 2 is displaceable together with the first slide component 1 relative to an object 3 along a guideway 4. In the example embodiment represented, the object 3 is an adjustment device for adjusting brake linings of a motor vehicle. As the invention is applicable in a variety of situations, no one being more preferable that the other, further details about the object 3 and individual parts thereof are not necessary.

The first slide component 1 is linearly displaceable in a first displacement direction 5; the second slide component 2 is linearly displaceable in a second displacement direction 6. The two displacement directions 5 and 6 are mutually perpendicular, that is, they are turned 90 degrees from each other. The electrical component (not shown) is secured to the first slide component 1. The first slide component 1 is preferably integrated within the housing of the electrical component and at a distance from the latter. The axis of rotation of the electrical component is perpendicular to the two displacement directions 5 and 6 so that the two displacement directions 5 and 6 are arranged radially with respect to the axis of rotation of the component.

The first slide component 1 has two parallel side walls, 11 and 12, the ends of which are provided with resilient arms 13, 14, 15, 16, each having an outwardly protruding projection. The elasticity can be increased by separating the arms 13–16 by notches or axial cutouts from the housing. In the example embodiment shown, the two linear side walls 11 and 12 are formed integrally on an annular base element 17 of the first slide component 1. This annular base element 17 is preferably part of the housing of the electrical component and serves in supporting the rotating parts of the component; such as the brush spring support in a potentiometer.

The second slide component 2 consists basically of a rectangular frame having a substantially rectangular central recess 20. Two side walls 21 and 23 running parallel to each other and parallel to the displacement direction 6, are provided with resilient arms 23, 24, 25, 26, each having an outwardly protruding projections. Two further side walls 27 and 28, running parallel to each other and parallel to the displacement direction 5, form the guideway for the first slide component with their inner sides. In use, projections on arms 13, 14, 15, and 16 of the first slide components lie against the inner wall of the side walls 27 and 28.

The side walls 27 and 28 have outwardly projecting center sections 29 and 30, so that only the sections lying between the sections 29, 30 and the side walls 21 and 22 serve as a guideway. The side walls 21 and 22 also serve at the same time as a limiting stop for the displacement of the first slide component 1, along axis 5.

Resilient arms 23, 24, 25, and 26 of the side walls 21 and 22 of the second slide component, have outwardly jutting projections that slide along the guideway 4. Guideway 4 is bounded by steps 31, which limits displacement of the second slide component. It is thus understandable that the guideway 4 cannot have a continuous construction, rather it can only consist of four sections, the length of which corresponds to the maximum displacement path of the second slide component.

ALTERNATIVE EMBODIMENTS

Figure 2:
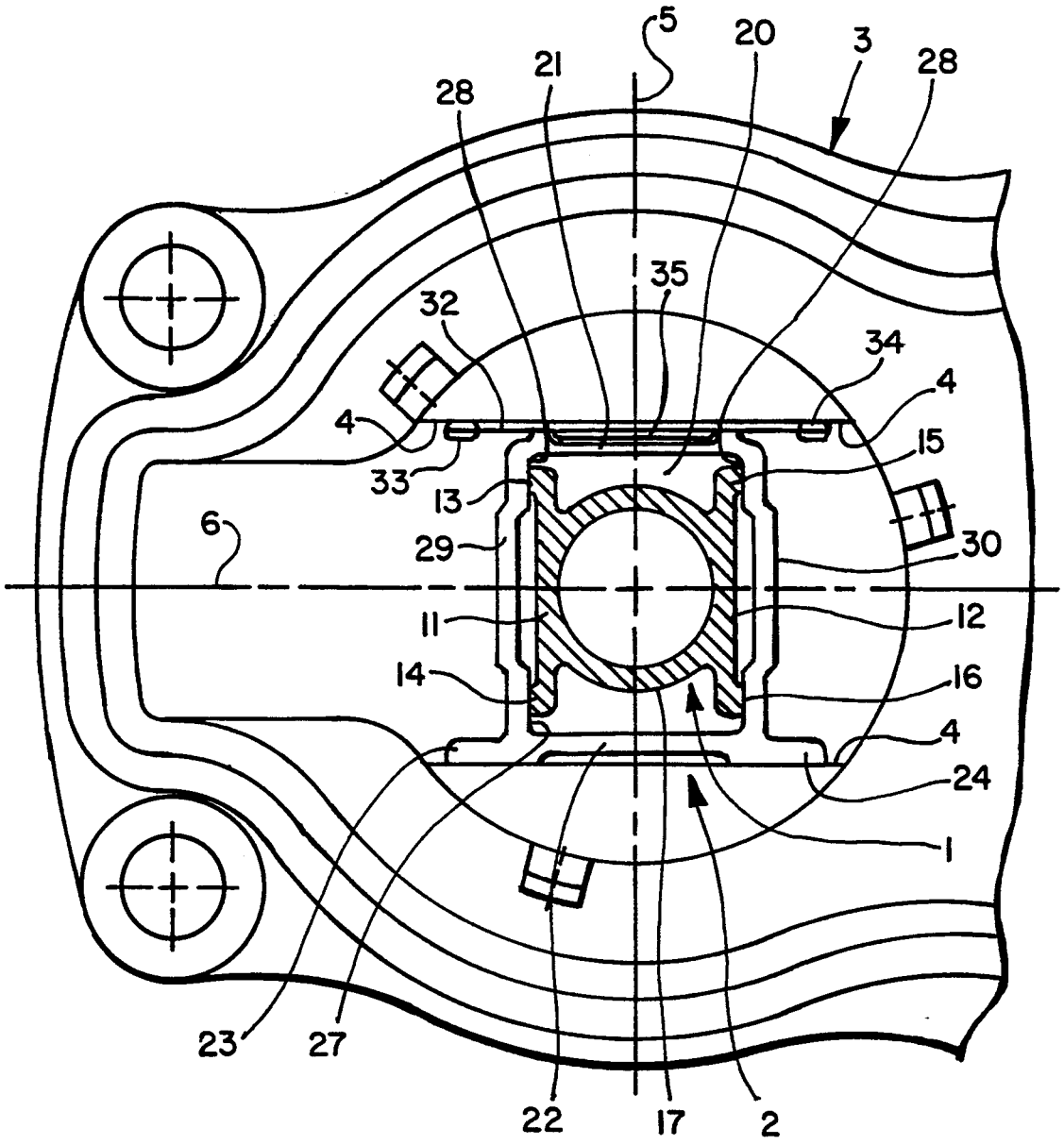
FIG. 2 is a cut-away plan view of an alternative embodiment in which one of the slide components has a metallic leaf spring.

The example embodiment according to FIG. 2 differs from that of FIG. 1, basically, in that the second slide component 2 has a metallic leaf spring 32 on one of its side walls 21, which is in contact with the guideway 4. Leaf spring 32 is solidly anchored in side wall 21 in plastic that is sprayed around it and therein. That is, a center section 35 of leaf spring 32 is anchored in the side wall 21 of the second slide component 2. Metallic spring arms then extends on both sides of section 35 beyond the rectangular contour of the second slide component. These spring arms are provided, on their ends, with cap-like projections 33 and 34, which lie against the associated guideway 4, and serve as sliding elements. The metallic leaf springs retain their spring properties for extended operating periods thereby improving the service life of the holding means. It is sufficient here to have a metallic leaf spring on only one of the side walls, 21 or 22, lying parallel with the guideway 4, as this one leaf spring will compensate for material fatigue, abrasion or other wear of the elastic arms 23 and 24. Of course, it is possible to equip the slide component with two such metallic leaf springs, but this only increases the manufacturing costs without giving any technical advantages.

Figure 3:
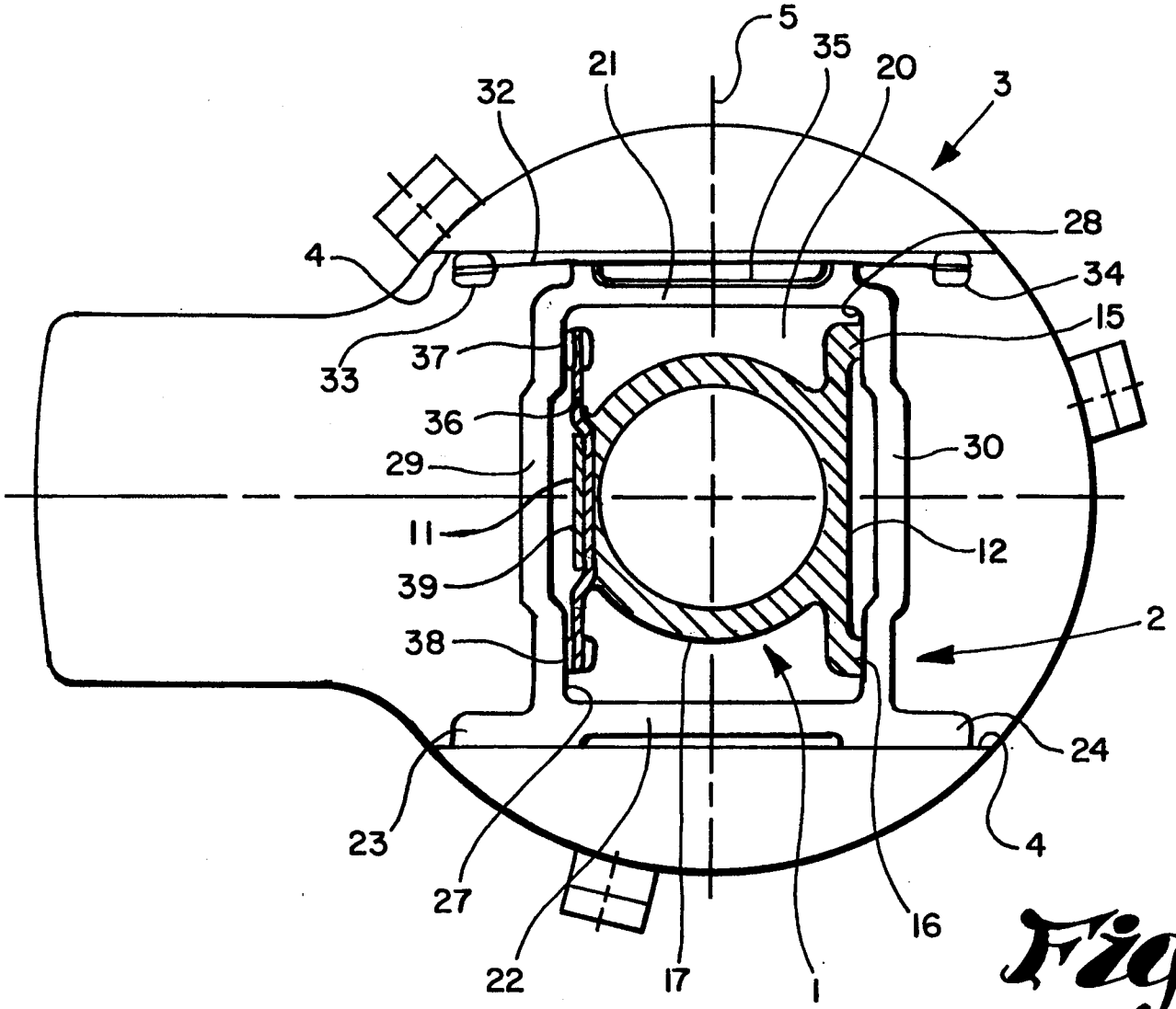
FIG. 3 is a similar plan view of another embodiment of the invention in which both slide components have a metallic leaf spring.

Similarly, it is possible to equip both slide components with a metallic leaf spring. The example embodiment shown in FIG. 3 thus differs from that of FIG. 2, in that, instead of the resilient arms 13 and 14 of FIG. 1, the first slide component 1 has, on one of its side walls 11, a metallic leaf spring 36, which is anchored with a center section 39 in the plastic of the first slide component. Metallic leaf spring 36 projects with two spring arms having cap-like projections 37 and 38 attached to the ends thereof. These two cap-like projections 37 and 38 lie against and slide on the guideway 27. To produce the first slide component 1, the leaf spring 36 is (as described above) inserted into the injection mold and plastic is injected around it, thereby solidly anchored the spring in center section 39. In theory, it is possible equip the first slide component with two such leaf springs, even though, as above, this would not bring any further technical advantages.

Figure 4:
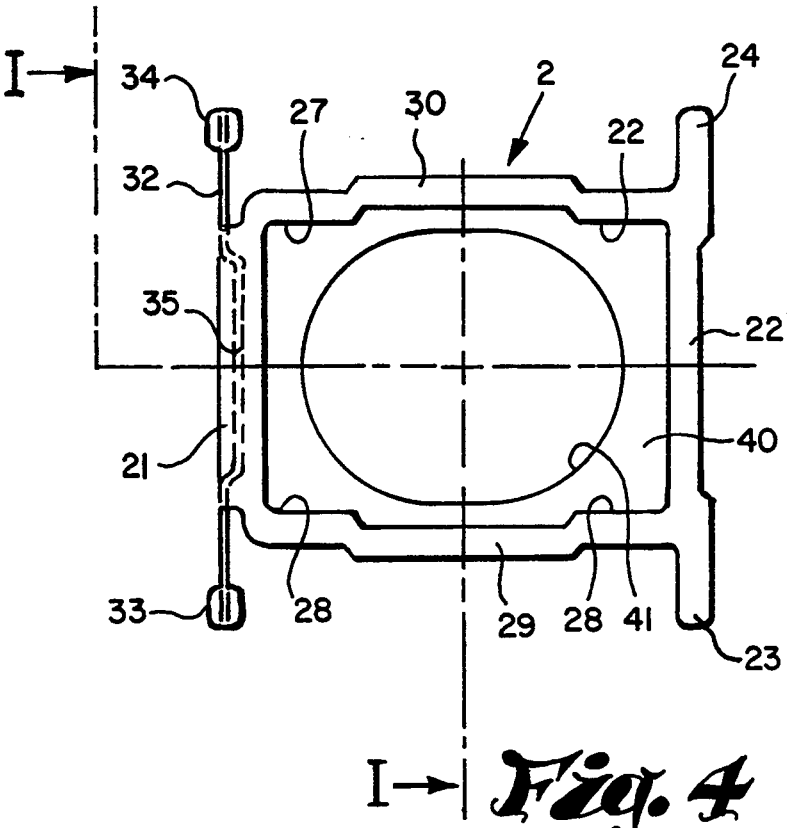
FIG. 4 is a plan view of a second slide component with a metallic leaf spring.
Figure 5:
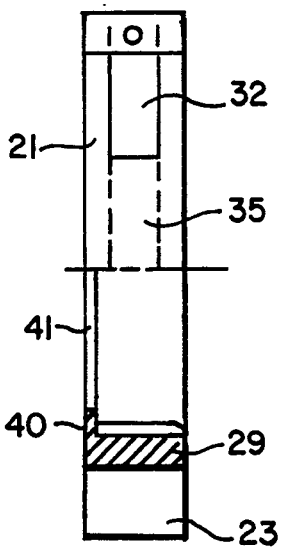
FIG. 5 is a sectional view taken along line I—I of FIG. 4.
Figure 6:
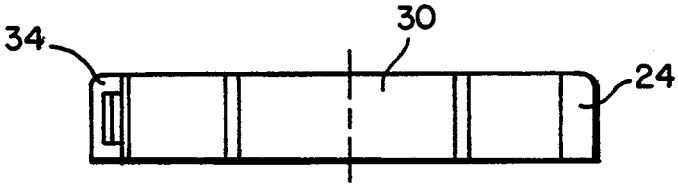
FIG. 6 is a side view of the slide component in FIG. 4.

FIGS. 4 to 6 show detailed views of another alternative embodiment of the second slide component. In the plan view of FIG. 4, the second slide component is substantially rectangular and has four side walls 21, 22, 29, 30 at right angles with each other. At the corners between the side wall 22 and the side walls 29 and 30, resilient arms 23 and 24, equidistant and extending parallel with the side wall, project somewhat beyond the plane of the side wall 22, and thus form precisely defined sliding surfaces with their outwardly facing sides. On the side opposite wall 22 is a leaf spring, having its center section embedded in the plastic of the side wall 21. As will be explained more precisely with reference to FIGS. 7 and 8, two spring arms projecting out of the plastic are connected to this center section through offsets and have cap-like projections 33 and 34 on their ends. The length of the spring arms of the leaf spring 32 is selected so that the ends of the leaf spring and the ends of the opposing plastic spring arms 23 and 24 extend the same distance beyond the side walls 29 and 30.

The alternative slide component 2 also has a base 40, with center opening set between 41, the frame-like side walls 21, 22, 29 and 30. Base 41 serves as a mounting the first slide component (of FIGS. 1 to 3) supporting it in a plane lying perpendicular to the axis of the spindle. The side walls 29 and 30 project outwardly in a center section, so that two sections of the guideway 28 and 28 are limited in their length. The center opening 41 of the base saves material and weight and prevents distortion of the slide component when the plastic hardens.

Figure 7:
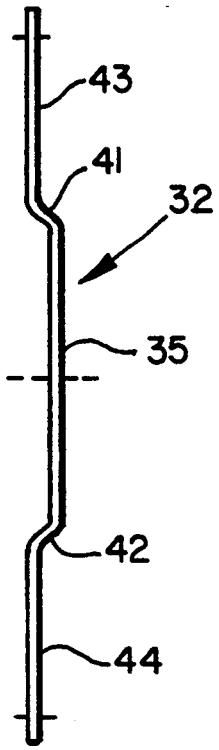
FIG. 7 is a side view of leaf spring in a alternative embodiment of the invention.
Figure 8:
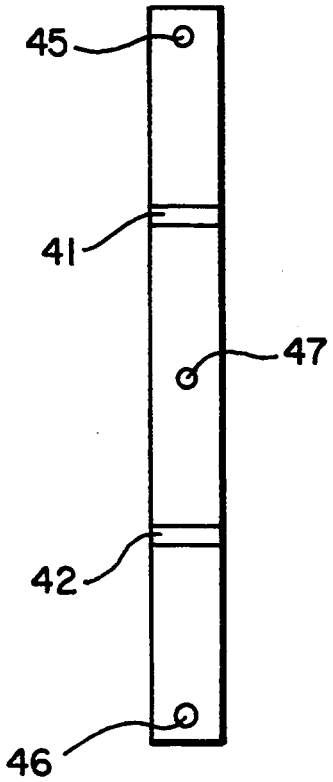
FIG. 8 is a plan view of the leaf spring in FIG. 7.

Finally, FIGS. 7 and 8 show a detailed view of the leaf spring, which is used in the alternative embodiments shown in FIGS. 2 to 6. In the plan view (FIG. 8), the leaf spring is an elongated rectangular strip. The side view of FIG. 7 shows that spring arms 43 and 44 are connected, through two offsets 41 and 42, to a center section 35. The plane of the spring arms is off-set with respect to that of said center section. An opening 45 and 46 is provided at the ends of the two spring arms 43 and 44 for securing the cap-like projections thereto. The projections can be secured by riveting. The leaf spring also has an opening 47, in the middle of the center section 35, to allow anchoring the leaf spring in the plastic material. When plastic material is injected around the leaf spring, it penetrates opening 47, forming a bridge between the plastic on both sides of the leaf spring, thereby solidly anchoring the leaf spring in the plastic.

What is claimed is:

1. Apparatus for mounting an electrical component having a housing on an object, said electrical component being actuatable by a rotating spindle comprising:

means for guiding said electrical component displaceably relative to the object in a first displacement direction and in a second displacement direction perpendicular to said first displacement direction, the two displacement directions being offset by 90 degrees in relation to the axis of said spindle;

a first guideway;

a second guideway on said object;

a first and second displaceable slide components;

said second displaceable slide component being displaceably guided in said second displacement direction by said second guideway on said object;

said second displaceable slide component having a substantially rectangular recess having at least one pair of opposing side walls adapted for receiving said first slide component;

said pair of opposing side walls of said second slide component forming a first guideway;

said first displaceable slide component being secured to said housing of said electrical component; and said first displaceable slide component being displaceably guided in said first displacement direction by said first guideway on said second displaceable slide component.

2. Apparatus as described in claim 1 wherein said first slide component has two side walls extending parallel with one another said side walls having resilient arms with outwardly jutting projections extending from their ends, and said projections being displaceably guided on said at least one pair of side walls of said second slide component.

3. Apparatus as described in claim 1 wherein said first slide component has two side walls parallel with one another and a metallic leaf spring is embedded in one of said side walls of said first slide component; said spring having two resilient arms extending beyond the base element of said first slide component, and said arms having cap-like projections being secured to the ends thereof.

4. Apparatus as described in claim 2 wherein said second slide component has two side walls parallel with each other, the of which each have an arm with protruding projections, said projections being guided displaceably on said second guideway on said object.

5. Apparatus as described in claim 2 wherein said second slide component has two side walls parallel with each other, a metallic leaf spring is embedded in one of said side walls of said second slide component; said spring having two resilient arms extending beyond the base element of the second slide component, and said arms having cap-like projections secured to the ends thereof.

6. Apparatus as described in claim 4 wherein said side walls of said second slide component are adapted to limit the displacement of said first slide component.

7. Apparatus as described in claim 5 wherein said second guideway on said object has steps adapted to limit the displacement of said second slide component.

8. Apparatus as described in claim 1 wherein said first slide component is formed integrally with said housing of said electrical component.

9. Apparatus as described in claim 1 wherein each of said pair of side walls of said second slide component which form the first guideway have a recess and a central section projecting outwardly from the recess.

10. Apparatus as described in claim 1 wherein said first slide component has an annular base element on which two side walls are formed tangentially, said annular base element being adapted to support the rotating parts of the electrical component.

11. Apparatus as described in claim 2 wherein said resilient arms are separated from the housing of the component by notches in the housing.

12. Apparatus as described in claim 2 wherein the resilient arms are separated from the housing of the component by axial cut-outs in the housing.

* * * * *